US010124976B2

(12) United States Patent
Müller

(10) Patent No.: US 10,124,976 B2
(45) Date of Patent: Nov. 13, 2018

(54) STRIPPING DEVICE

(71) Applicant: GIESECKE & DEVRIENT GMBH, München (DE)

(72) Inventor: Julian Müller, Poing (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 0 days.

(21) Appl. No.: 15/303,967

(22) PCT Filed: Apr. 24, 2015

(86) PCT No.: PCT/EP2015/000859

§ 371 (c)(1),
(2) Date: Oct. 13, 2016

(87) PCT Pub. No.: WO2015/165579

PCT Pub. Date: Nov. 5, 2015

(65) Prior Publication Data

US 2017/0036878 A1 Feb. 9, 2017

(30) Foreign Application Priority Data

Apr. 28, 2014 (DE) ..... 10 2014 006 253

(51) Int. Cl.
*B65H 29/00* (2006.01)
*B65H 29/56* (2006.01)
*B65H 29/51* (2006.01)

(52) U.S. Cl.
CPC ..... *B65H 29/56* (2013.01); *B65H 29/006* (2013.01); *B65H 29/51* (2013.01);
(Continued)

(58) Field of Classification Search
CPC ..... B65H 29/54; B65H 29/56; B65H 29/066; B65H 29/51; B65H 2301/4481; G03G 15/6532
See application file for complete search history.

(56) References Cited

U.S. PATENT DOCUMENTS 3,804,401 A * 4/1974 Stange ..... G03G 15/6532 271/195
3,926,429 A 12/1975 Satomi et al.
(Continued)

FOREIGN PATENT DOCUMENTS

DE 2359835 C3 4/1985
DE 19735382 A1 2/1999
(Continued)

OTHER PUBLICATIONS

German Search Report for corresponding German Application No. 102014006253.8, dated Sep. 5, 2014.
(Continued)

*Primary Examiner* — Jeremy R Severson
(74) *Attorney, Agent, or Firm* — Workman Nydegger

(57) ABSTRACT

A stripping device for stripping sheet-shaped objects from a roller includes at least one stripper. The stripper is mounted rotatably about a bearing and includes stripping portion configured to be tapering to a point and a support portion which is different from the stripping portion. The stripping portion and the support portion are arranged relative to each other and the stripper is mounted such that, when the stripper is pressed against the roller with prestressing during operation, the stripper has two mutually spaced apart contact points with the roller, which contact points are defined by the stripping portion and the support portion of the stripper.

18 Claims, 2 Drawing Sheets

(52) U.S. Cl.
CPC ..... *B65H 2301/4191* (2013.01); *B65H 2301/4481* (2013.01); *B65H 2301/44314* (2013.01); *B65H 2404/7414* (2013.01); *B65H 2701/1912* (2013.01)

(56) References Cited

U.S. PATENT DOCUMENTS 3,992,000 A * 11/1976 Martin ..... B65H 29/54 118/245
4,408,757 A * 10/1983 Yarm ..... B65H 29/56 271/311
5,997,965 A * 12/1999 Shimazu ..... C08K 3/32 271/307
6,293,545 B1 * 9/2001 Hanks ..... B41J 2/01 271/311
6,375,182 B1 4/2002 Sting et al.
6,490,428 B1 * 12/2002 Fromm ..... G03G 15/2028 399/323
7,245,346 B2 * 7/2007 Weiner ..... G02F 1/1333 349/187
7,490,823 B2 * 2/2009 Oishi ..... B65H 5/28 242/528
8,185,029 B2 * 5/2012 Isahai ..... G03G 15/2028 399/323
8,526,869 B2 * 9/2013 Shinkawa ..... G03G 15/20 271/307
9,546,066 B2 1/2017 Iwasaki
2002/0096816 A1 * 7/2002 Sasaki ..... B65H 5/28 271/3.14
2002/0096818 A1 * 7/2002 Mochizuki ..... B65H 5/28 271/18
2004/0151521 A1 * 8/2004 Rasch ..... G03G 15/2028 399/323
2004/0178573 A1 * 9/2004 Hasegawa ..... B65H 29/54 271/307
2013/0160796 A1 6/2013 Cooke et al.
2015/0298928 A1 10/2015 Iwasaki

FOREIGN PATENT DOCUMENTS

JP 2001199607 A * 7/2001 ..... B41J 2/01
WO 2002027626 A1 4/2002
WO 2013140686 A1 9/2013

OTHER PUBLICATIONS

International Preliminary Report on Patentability for corresponding International PCT Application No. PCT/EP2015/000859, dated Nov. 1, 2016.
International Search Report for corresponding International PCT Application No. PCT/EP2015/000859, dated Jul. 27, 2015.

* cited by examiner

STRIPPING DEVICE

BACKGROUND

The present invention relates to a stripping device for stripping sheet-shaped objects from a roller. In particular, the invention relates to a stripping device for a foil winding repository for stripping sheet-shaped objects from a storage roller of the foil winding repository.

Foil winding repositories are known in the state of the art and are preferably employed as intermediate storage in apparatus for processing sheet-shaped objects, for example banknote processing machines or automatons for depositing and withdrawing banknotes.

A foil winding repository typically has one or two foils that can be unwound from corresponding supply rollers and rewound on these again. Furthermore, a storage roller is provided on which the one or several foils can be wound. Sheet-shaped objects, such as banknotes, are stored on the storage roller of the foil winding repository by winding the objects, after feeding them to the foil winding repository, on the storage roller together with the foils and storing them between individual layers of foil, wherein the foils are simultaneously unwound from the supply roller. The release of the sheet-shaped objects stored between the layers of foil is effected by unwinding the at least one foil from the storage roller, wherein the foil is rewound on the supply roller and the sheet-shaped objects are discharged, for example via suitable transport rollers or transport belts.

When outputting the sheet-shaped objects from the storage roller, it can occur that individual sheet-shaped objects remain adhering to the roller. To prevent this, a stripping device is employed which strips such adherent sheet-shaped objects from the roller.

Basically, stripping devices can also be used for stripping of sheet-shaped objects from such rollers which are provided in a device for merely transporting sheet-shaped objects, without the roller serving as a storage roller of a foil winding repository. Such rollers can be found for example in printers or similar devices.

Currently employed stripping devices include as stripper an elongated scraper that is tapering to a point at the end touching the roller. The scraper is configured to be elastic, preferably of an elastomer, and is pressed against the roller with prestressing during operation. In particular in connection with a foil winding repository the storage roller of which inherently has a radius that varies over time and an irregular roller surface, the following difficulties are encountered. The setting angle and the pressure with which the scraper is pressed against the roller vary depending on the radius of the roller and the surface structure of the roller. A too steep or too flat angle of the scraper can result in sheet-shaped objects adhering to the roller not being grasped by the scraper and consequently not being stripped. Further, there is the risk that, due to irregularities of the roller surface, the end of the scraper touching the roller temporarily loses contact with the roller surface. Here, too, it can occur that sheet-shaped objects adhering to the roller are not stripped off.

SUMMARY

It is the object of the present invention to suggest a stripping device which takes account of the disadvantages described above.

According to a preferred embodiment a stripping device for stripping sheet-shaped objects from a roller, such as for example sheet-shaped value documents, such as banknotes or the like, includes at least one stripper. The stripper is mounted rotatably about a bearing and includes a stripping portion, which, in cross-section, perpendicularly to a rotational axis of the roller, is configured to be tapering to a point. Further, the stripper includes a support portion different from the stripping portion. The stripping portion and the support portion are arranged relative to each other and the stripper is mounted such that, when the stripper it is pressed against the roller with prestressing during operation, for example with a spring bias, the stripper always has exactly two mutually spaced apart contact points with the roller, said contact points being defined by the stripping portion and the support portion of the stripper. This applies also when the roller radius of the roller varies and when there are irregularities of the roller surface.

The definition of the contact points is to be understood here such that the stripper, viewed in cross section perpendicularly to the rotational axis of the roller, has exactly two contact points with the roller. In other words, the stripping portion and/or the support portion can per se touch the roller also in more than one point. Preferably, the contact, at least in the case of the stripper, is effected along a contact edge which extends in axial direction along the roller surface.

Due to the fact that in addition to the stripping portion always also the support portion touches the roller, and the stripper is mounted rotatably about the bearing, the setting angle of the stripping portion relative to the roller can be kept substantially constant. A too steep or too flat setting angle can thus be avoided.

On the one hand, the stripper is held against the roller with suitable prestressing. A change of the setting angle due to a changing roller radius can be avoided already due to the geometry of the stripper. Through the two contact points to the roller, substantially a constant setting angle of the stripping portion is ensured when the roller surface is regular, also when the degree of the prestressing changes due to a change of the radius of the roller.

On the other hand, in the event that the setting angle between the stripping portion and the roller changes due to irregularities in the roller surface, a counter pressure generated immediately by the support portion with the aid of the rotatable mounting can substantially restore the original, preset setting angle of the stripping portion to the roller. Such irregularities in the roller surface can occur particularly in connection with foil winding repositories, when not only individual banknotes, but smaller bundles of banknotes are intermediately stored there.

Preferably the stripper is adapted such that, with reference to the rotational axis of the roller, the bearing is arranged radially spaced apart from the roller and between the two contact points during operation. In other words, the bearing is arranged radially spaced apart from the roller in an angle segment which, viewed in cross section perpendicularly to the rotational axis of the roller, is defined by the rotational axis of the roller and the two contact points. Such an arrangement of the bearing ensures that both contact points always remain in contact with the roller surface, also when the roller radius varies and/or there are uneven areas of the roller surface.

In order to ensure a stable arrangement of the stripper on the roller during operation, an angle enclosed in the direction of the roller between a first line connecting the bearing with the one contact point and a second line connecting the bearing with the other contact point preferably amounts to between around 60° and 120°, preferably around 90°.

Preferably, the stripping device includes at least two strippers. More than two strippers are preferred, more than five strippers are particularly preferred, for example six strippers. The provision of a plurality of strippers allows a more accurate scanning of the surface of the roller in comparison to the provision of only one correspondingly broader stripper.

According to a first preferred embodiment, the at least one stripper is mounted rotatably about an axis which is arranged parallel to the rotational axis of the roller. This type of mounting supports in an optimal way the arrangement of the stripper relative to the roller for forming the two contact points.

According to a second preferred embodiment the at least one stripper can also be mounted on gimbals. Thus, uneven areas of the roller surface can be compensated optimally in the axial direction in addition.

As mentioned above, the stripping device can include a plurality of strippers. It can be provided that some or all of the stripper are rotatably mounted separately. This can also serve to further optimize a scanning of the roller surface.

The stripping device can comprise for example a carriage on which the at least one stripper is arranged. The carriage is adapted to be movably guided in a device for processing sheet-shaped objects and to be pressed in the direction of the roller with prestressing during operation. By means of this movability of the carriage and the prestressing acting on the carriage varying roller radii can be compensated in particular.

To further compensate for slightly uneven areas or irregularities of the roller surface a further spring element can be provided. The at least one stripper can be connected to the carriage via such a spring element. This spring element is adapted, due to the prestressing of the carriage, to be prestressed against the roller during operation i.e. to prestress the stripper against the roller. As spring element for example a leaf spring, a spring plate or the like can be used.

It is understood that also in the case that a plurality of strippers are present, some or all of these strippers can be separately connected to the carriage via a corresponding spring element. In this way, the surface of the roller can be optimally scanned by the various strippers.

The support portion of the stripper is preferably adapted to be rounded in cross section perpendicular to the rotational axis of the roller in the region in which it is adapted to touch the roller during operation. According to a preferred variant, the corresponding region can be formed, for example, by a surface portion of a circular cylinder. The support portion can also be formed by a rotatable roller or the like.

Structurally considered, the at least one stripper can include an angular portion. The stripping portion is arranged here at the end of a first angular arm and the support portion at the end of a second angular arm. The two angular arms enclose a predetermined angle facing the roller during operation, which, as mentioned, can amount to around 60 to 120°, preferably around 90°. The bearing of the stripper is preferably arranged in the region of the angular portion in which the two angular arms meet.

A preferred embodiment of a system according to the invention therefore includes at least one roller for transporting and/or storing sheet-shaped objects, as well as an above-described stripping device for stripping the sheet-shaped objects from the roller.

According to a preferred embodiment, the roller is a storage roller of a foil winding repository for storing the sheet-shaped objects.

According to a further preferred embodiment, the system is a bank-note processing machine.

BRIEF DESCRIPTION OF THE DRAWINGS

The present invention will hereinafter be described by way of example with reference to the attached drawings. The figures are described as follows.

DETAILED DESCRIPTION OF VARIOUS EMBODIMENTS

Figure 1:
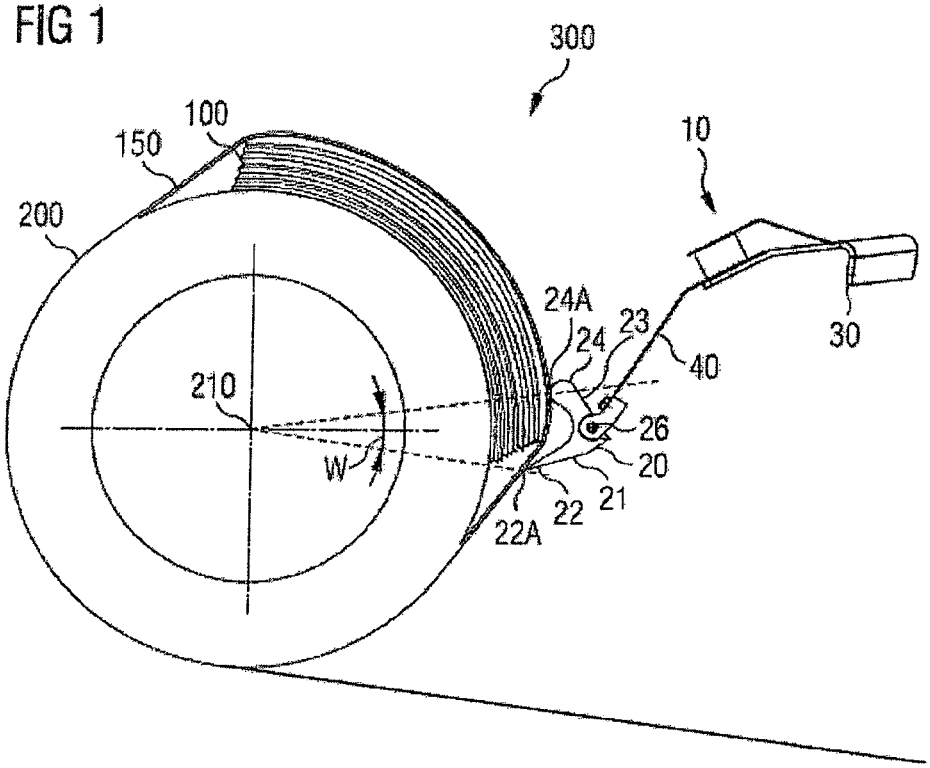
FIG. 1 a preferred embodiment of a stripping device according to the invention during operation in a side view and FIG. 2 the stripping device of FIG. 1 in a perspective view.

With reference to FIG. 1, a stripping device 10 for stripping sheet-shaped objects 100 from a roller 200 is shown. The roller 200 in the shown example corresponds to a storage roller of a foil winding repository for storing the sheet-shaped objects, for example in a bank-note processing machine. The sheet-shaped documents 100 are stored between different layers of a foil 150, as is indicated in FIG. 1. In the course of the process, therefore the diameter of the storage roller 200 will increase inherently—and decrease again during the outputting of the stored documents 100.

It can occur that the documents 100 are also stored in bundles, which can lead to uneven areas in the roller surface. The representation in FIG. 1 is not to scale, but illustrates the situation only schematically.

The stripping device 10 can alternatively be used also in connection with rollers which are provided merely for transporting sheet-shaped objects, but not for intermediate storage.

During the outputting of the sheet-shaped documents 100 from the storage roller 200, it can occur that individual documents remain adhering to the roller 200. To prevent this, the stripping device 10 is used.

The stripping device 10 includes at least one stripper 20 which is rotatably mounted about a bearing 26. In the shown example, a purely axial bearing 26 is used about an axis which extends parallel to the rotational axis 210 of the roller 200. Alternatively, also a mounting on gimbals can be used, allowing additionally a rotation about an axis which extends perpendicularly to the rotational axis 210.

Figure 2:
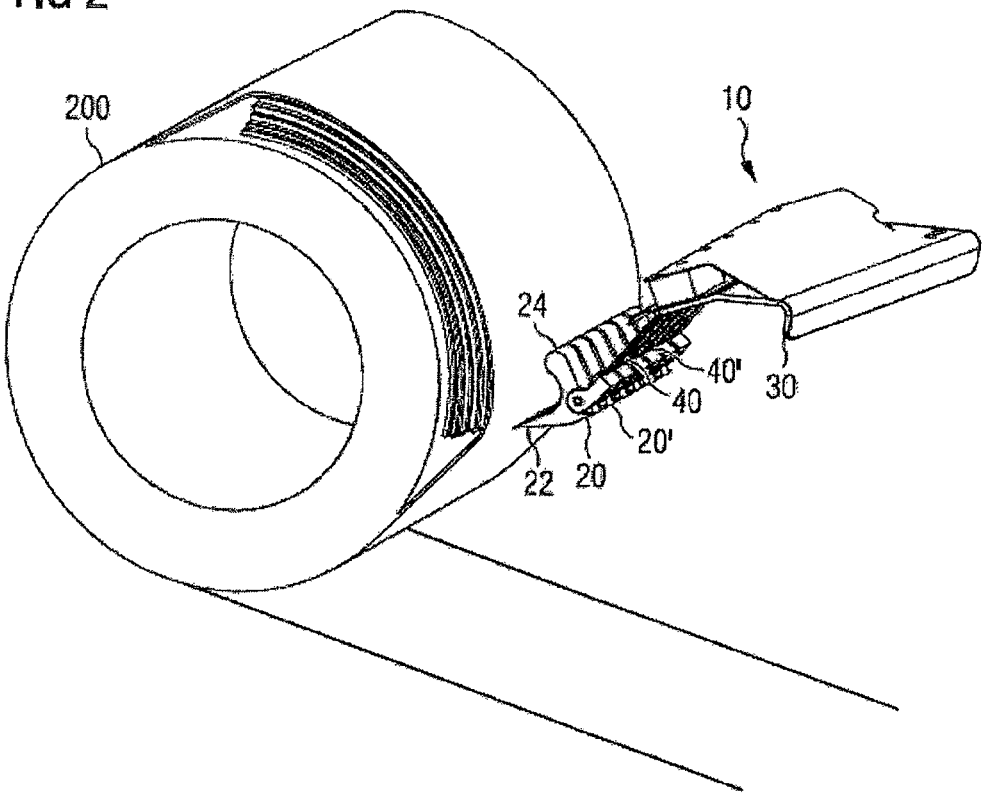

As shown with reference to FIG. 2, the stripping device 10 actually includes a plurality of identical strippers 20, 20' which are arranged next to each other in the axial direction of the roller 200. In the following, initially only one of these strippers 20 will be described in more detail.

The stripper 20 includes—viewed in cross section perpendicularly to the rotational axis 210 of the roller 200—a stripping portion 22 tapering to a point for stripping sheet-shaped objects from the roller 200. As rudimentarily recognizable in FIG. 2, the stripping portion 22 touches the roller 200 during operation along a contact edge which extends in the axial direction of the roller 200.

The stripper 20 further comprises a support portion 24. As explained in the following, said support portion is arranged and adapted to form a second contact point with the roller surface during operation, in addition to the stripping portion 22. The stripper 20 is configured and mounted in such a way that, during operation, when the stripper 20 is pressed against the roller 200 with prestressing, the stripper 20 always forms two contact points 22A, 24A with the roller surface. The contact points 22A, 24A are therein defined by precisely those points in which the stripping portion 22 and the support portion 24 are in contact with the roller 200.

This is ensured by arranging the bearing 26, with reference to the rotational axis 210 of the roller 200, radially spaced apart from the roller 200 and between the two contact points 22A, 24A. In other words, the bearing 26, viewed in cross section perpendicularly to the rotational axis 210 of the roller 200, is arranged radially spaced apart from the roller 200 and within an angle segment W which is defined by the rotational axis 210 and the two contact points 22A and 24A.

The angle which is enclosed in the direction of the roller 200 between a first line connecting the bearing 26 to the first contact point 22A and a second line connecting the bearing 26 to the second contact point 24A, typically amounts to between around 60° and 120°, in the shown example around 90°.

The stripper 20 is connected to a carriage 30. The carriage 30 is adapted to be movably guided and to be pressed against the roller with prestressing during operation in a corresponding apparatus, for example a bank-note processing machine. The movable guidance of the carriage preferably extends substantially in a radial direction with reference to the roller 200 or such that the stripper 20 is displaced radially upon moving the carriage 30.

In the shown embodiment, the stripper 20 is connected to the carriage 30 via a further spring element 40, which can for example be configured as a spring plate or the like. In this way, even small irregularities of the roller surface can be caught.

The stripper 20 in the shown example is configured angularly and includes two angular arms 21 and 23. The bearing 26 is arranged in the region of the stripper 20 in which the two angular arms 21, 23 meet. At the end of the first angular arm 21 the stripping portion 22 is arranged. At the end of the second angular arm 23 the support portion 24 is arranged. The support portion 24 is configured to be rounded in the region where it touches the roller 200. Preferably, this region can correspond to a surface portion of a circular cylinder, for example.

In FIG. 2 the arrangement of FIG. 1 is shown in perspective view. It can be seen here that the stripping device 10 has a plurality of identical strippers 20, 20'. The number of strippers 20, 20' can be variable. The embodiment shown includes six strippers 20.

Each of these strippers 20, 20' is rotatably supported separately and separately connected to the carriage 30 via a spring element 40, 40'. In this way, the surface of the roller 200 can be scanned optimally by means of the plurality of strippers, so that sheet-shaped objects 100 adhering to the roller 200 can be stripped reliably also when the roller radius varies and/or there are uneven areas of the roller surface.

The invention claimed is:

1. A stripping device for stripping sheet-shaped objects from a roller, including at least one stripper which includes a stripping portion configured to be tapering to a point and a support portion, wherein the stripping portion and the support portion of the stripper are arranged relative to each other and each are mounted rotatably about a bearing such that, when, during operation with a roller, the stripper is pressed against said roller with prestressing, the stripper has two contact points with the roller which are defined respectively by the stripping portion and the support portion of the stripper;

wherein an angle enclosed in the direction of the roller between a first line which connects the bearing to the one contact point and a second line which connects the bearing to the other contact point amounts to between 60° and 120°.

2. The stripping device according to claim 1, wherein the stripper is adapted such that, during operation with the roller, the bearing is arranged, with reference to a rotational axis of the roller, radially spaced apart from the roller and between the two contact points.

3. The stripping device according to claim 2, wherein an angle enclosed in the direction of the roller between a first line which connects the bearing to the one contact point and a second line which connects the bearing to the other contact point amounts to 90°.

4. The stripping device according to claim 1, wherein the stripping device includes at least two strippers.

5. The stripping device according to claim 1, wherein the at least one stripper is mounted axially to be rotatable about an axis which is arranged parallel to a rotational axis of the roller, when, during operation with the roller, the stripper is pressed against the roller with prestressing.

6. The stripping device according to claim 5, wherein the stripping device includes a plurality of strippers which are each rotatably mounted separately.

7. The stripping device according to claim 5, wherein the at least one stripper is mounted on gimbals.

8. The stripping device according to claim 7, wherein the stripping device includes a plurality of strippers which are each rotatably mounted separately.

9. The stripping device according to claim 1, wherein the stripping device includes a carriage on which the at least one stripper is arranged, wherein the carriage is adapted to be movably guided and, during operation with the roller, is adapted to be pressed in the direction of said roller with prestressing.

10. The stripping device according to claim 9, wherein the stripping device includes a plurality of strippers which are respectively connected to the carriage separately via a spring element.

11. The stripping device according to claim 9, wherein the at least one stripper is connected to the carriage via a spring element which, during operation with the roller, is adapted to be prestressed against said roller due to the prestressing of the carriage.

12. The stripping device according to claim 11, wherein the stripping device includes a plurality of strippers which are respectively connected to the carriage separately via a spring element.

13. The stripping device according to claim 1, wherein the support portion is configured to be rounded in the region in which, during operation with the roller, it is adapted to touch the roller.

14. The stripping device according to claim 1, wherein the at least one stripper includes an angular portion, wherein the stripping portion is arranged at the end of a first angular arm and the support portion is arranged at the end of a second angular arm, and wherein the bearing of the at least one stripper is arranged in the region in which the two angular arms meet.

15. A system including the at least one roller for transporting sheet-shaped objects and a stripping device according to claim 1 for stripping the sheet-shaped objects from the roller.

16. The system according to claim 15, wherein the system is a bank-note processing machine.

17. The system according to claim 15, wherein the roller is a storage roller of a foil winding repository for intermediate storage of sheet-shaped objects.

18. The system according to claim 17, wherein the system is a bank-note processing machine.

* * * * *